US007814992B2

(12) United States Patent
Olsen

(10) Patent No.: US 7,814,992 B2
(45) Date of Patent: Oct. 19, 2010

(54) DEVICE FOR STORAGE OF TUBULARS, APPARATUS FOR HANDLING TUBULARS AND A METHOD FOR DISASSEMBLING A PIPE STRING

(75) Inventor: Fred Olsen, Oslo (NO)

(73) Assignee: Fred. Olsen Energy ASA, Oslo (NO)

( * ) Notice: Subject to any disclaimer, the term of this patent is extended or adjusted under 35 U.S.C. 154(b) by 159 days.

(21) Appl. No.: 11/793,915

(22) PCT Filed: Dec. 21, 2005

(86) PCT No.: PCT/NO2005/000471

§ 371 (c)(1),
(2), (4) Date: Nov. 26, 2007

(87) PCT Pub. No.: WO2006/068497

PCT Pub. Date: Jun. 29, 2006

(65) Prior Publication Data

US 2008/0149342 A1 Jun. 26, 2008

(30) Foreign Application Priority Data

Dec. 23, 2004 (NO) ..... 20045643

(51) Int. Cl.
*E21B 19/00* (2006.01)

(52) U.S. Cl. ..... 175/85; 414/22.68; 414/22.63; 175/52; 166/358

(58) Field of Classification Search ..... 166/358, 166/359, 380, 341; 414/22.68, 22.63; 175/58, 175/85, 5, 8, 10, 52
See application file for complete search history.

(56) References Cited

U.S. PATENT DOCUMENTS

| | | | | | |
|---|---|---|---|---|---|
| 2,606,003 | A | | 8/1952 | McNeill | |
| 3,339,747 | A | | 9/1967 | Sherman | |
| 3,539,024 | A | * | 11/1970 | Bleyl | 175/85 |
| 3,741,320 | A | | 6/1973 | Hilfing | |
| 3,987,910 | A | | 10/1976 | Brunato | |
| 4,044,895 | A | * | 8/1977 | Adair | 414/22.63 |
| 4,108,318 | A | * | 8/1978 | Rode et al. | 414/22.51 |
| 4,117,941 | A | * | 10/1978 | McCleskey et al. | 414/22.63 |

(Continued)

FOREIGN PATENT DOCUMENTS

WO 01/33029 5/2001

OTHER PUBLICATIONS

International Search Report for PCT/NO2005/000471 mailed May 18, 2006.

(Continued)

*Primary Examiner*—Thomas A Beach
(74) *Attorney, Agent, or Firm*—Nixon & Vanderhye, PC

(57) ABSTRACT

An apparatus for storing tubulars on a floating semi-submersible drilling or production vessel. The apparatus comprises a storage device for storing tubulars in a submerged position, essentially below a splash zone. The storage device is generally open to the surroundings so that the tubulars are externally exposed to surrounding water. It is also described an apparatus for transporting tubulars between a storage and a derrick on an offshore drilling and/or production platform having a platform deck. The apparatus is situated below the platform deck and is adapted for movement under the platform deck. A method for disassembling a pipe string is also described.

21 Claims, 14 Drawing Sheets

U.S. PATENT DOCUMENTS

Figure 1:
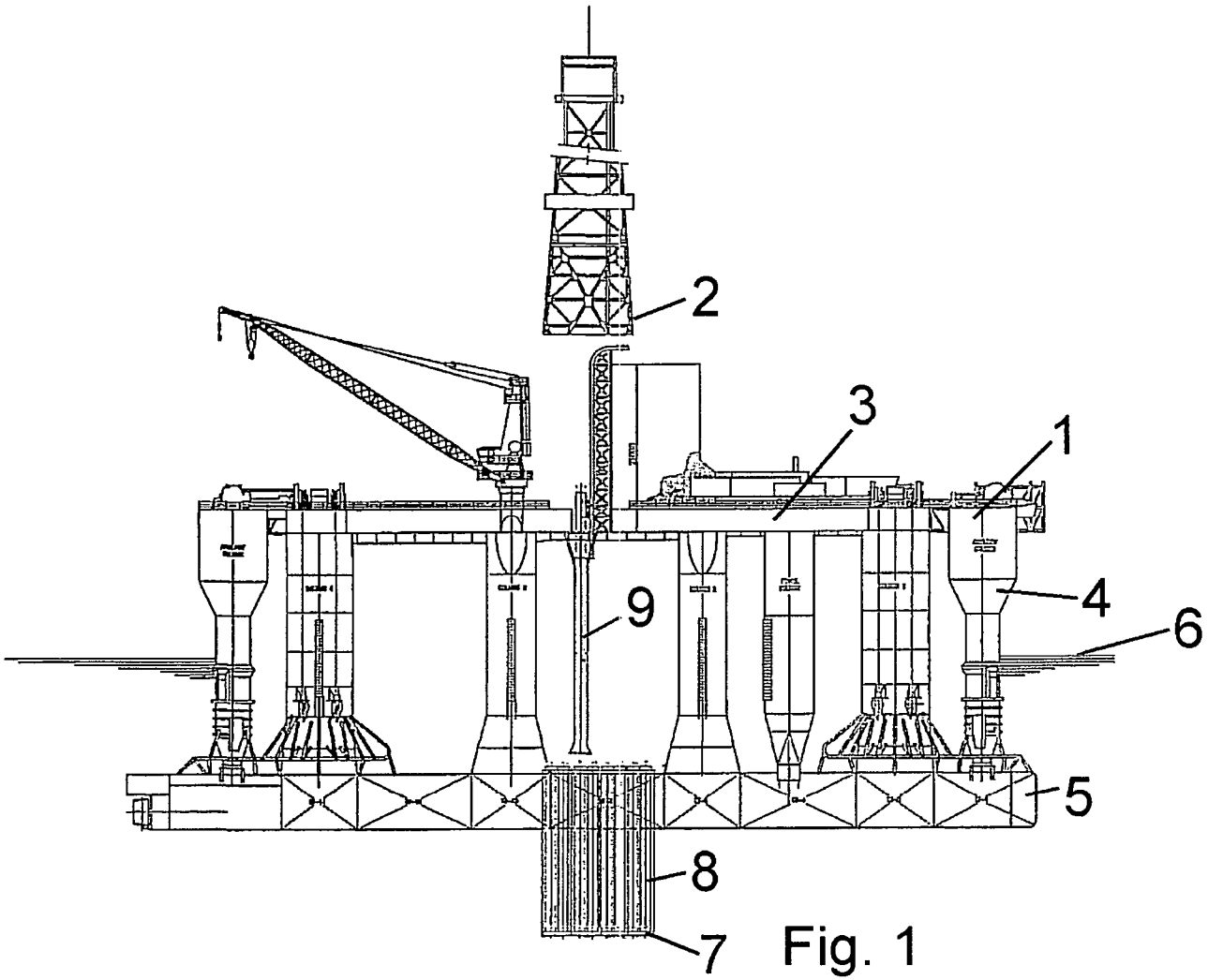

| | | | | |
|---|---|---|---|---|
| 4,208,158 | A * | 6/1980 | Davies et al. | 414/22.68 |
| 4,367,796 | A * | 1/1983 | Bolding | 166/341 |
| 4,646,672 | A | 3/1987 | Bennett et al. | |
| 4,708,563 | A * | 11/1987 | Van Den Berg et al. | 414/22.66 |
| 4,762,185 | A | 8/1988 | Simpson | |
| 4,899,682 | A * | 2/1990 | Pouget et al. | 114/264 |
| 5,647,443 | A * | 7/1997 | Broeder | 175/5 |
| 6,217,258 | B1 * | 4/2001 | Yamamoto et al. | 405/201 |
| 6,250,395 | B1 | 6/2001 | Torres | |
| 6,524,049 | B1 | 2/2003 | Minnes | |
| 6,766,860 | B2 | 7/2004 | Archibald et al. | |
| 6,789,981 | B2 * | 9/2004 | Pollack | 405/224.4 |
| 2001/0025727 | A1 * | 10/2001 | Byrt et al. | 175/7 |
| 2005/0109537 | A1 * | 5/2005 | Ayling | 175/5 |

OTHER PUBLICATIONS

Norwegian Search Report for NO 20045643, date of report: Jul. 1, 2005.

Written Opinion for PCT/NO2005/000471 mailed May 18, 2006 (5 pages).

* cited by examiner

DEVICE FOR STORAGE OF TUBULARS, APPARATUS FOR HANDLING TUBULARS AND A METHOD FOR DISASSEMBLING A PIPE STRING

This application is the US national phase of international application PCT/NO2005/000471 filed 21 Dec. 2005, which designated the U.S. and claims benefit of NO 20045643, filed 23 Dec. 2004, the entire contents of each of which are hereby incorporated by reference.

The present invention relates to devices for storage of tubulars on board a floating vessel as stated in the preamble of claim 1. It also relates to an apparatus for handling tubulars between a storage and a derrick as stated in the preamble of claim 14. Furthermore the invention relates to a method for disassembling a pipe string as stated in the preamble of claim 17.

Offshore oil and gas exploration and production is dependent on drilling from floating semisubmersible platforms or drillships. Many drilling units were built in the 70's for drilling in water depths down to 1 500 ft (500 meters)($2^{nd}$ and $3^{rd}$ generation), while as exploration has gone deeper, a number of drilling units have later been built for and operate in water depths beyond 5 000 ft (1500 meters), the water depth record now standing at app. 10 000 ft (3000 meters)("ultra deep water")($4^{th}$ and $5^{th}$ generation).

Down to app. 5000 ft, the rigs may be moored by combinations of chain and steel wire or synthetic rope, while in deeper water the drilling units are primarily kept in position by azimuth thruster propellers and dynamic positioning. Due to their high deck load capacity and suitability for dynamic positioning, the majority of ultra deep water drilling units is drill ships.

The drilling units utilize a 21" (533,5 mm) diameter steel riser to circulate drilling mud and cuttings back to surface for well control, cleaning and recirculation. The riser is bolted clamped together from 50 to 80 ft (15-24 meters) long joints, typically equipped with syntactic buoyancy to obtain close to neutral weight in seawater.

Typically, the riser joints are individually added to or taken off the riser string on the drill floor, while the suspended lower part of the riser string, including blow out preventer (BOP), is hung off on a spider placed above the rotary table (the opening in the drill floor which allows running of drill string and other tubulars). Riser joints are typically transported by crane or other pipe handling equipment to horizontal storage on deck, or to vertical or slanted storage racks at or above deck level. In either case, the drilling unit must provide space, buoyancy and stability for a large volume and weight of riser pipe.

The higher day rates achieved in the market by the $4^{th}$ and $5^{th}$ generation deepwater drilling units makes upgrade of units with shallow water capacity an attractive option.

All deepwater upgrades mean more weight on the rig, and increased payload requirements. It is also evident that the biggest bottleneck in the utilization of a floating vessel is the riser storage volume and weight.

Current $4^{th}$ generation deepwater rigs have displacements up to twice that of the bulk of shallow water (1500 ft w.d)(500 meters water depth) rigs, with associated higher building costs.

There is known several different storage and handling systems for tubulars. Some of these are aimed at shifting the storage volume and weight distribution to a lower level in order to improve stability.

U.S. Pat. No. 3,339,747 shows a pipe rack for well drilling apparatus, wherein a pipe well for vertical storage of pipes is suspended from a drilling platform. The pipe well incorporates a wedge type of arrangement in the bottom for vertical movement of the risers.

Although this US-patent shows a storage of the risers below the main deck, it has several disadvantages. The pipes are stacked dry in a column (a riser well, which is closed in the bottom). This involves increased steel weight and hydrodynamic loading. The weight of the pipes in storage is carried by the platform displacement, not by the risers' own buoyancy. As a result the centre of gravity is not reduced as much as it could have been.

In addition to this the pipes are located above the splash zone, so that the enclosing structure may be exposed to severe wave loading. The storage well is also cantilevered from deck, requiring heavier deck reinforcement.

Furthermore the wedge arrangement for moving the pipes vertically is exposed to damage and difficult to access for repair.

U.S. Pat. No. 3,987,910 shows an apparatus for racking drill pipes on floater type platforms. This is an X-Y racking apparatus combined with a container located in the substructure area of the floating platform for supporting the pipes. In one embodiment the container is of a closed type for use on a drill ship. It protrudes below sea level, and also below the bottom of the hull to achieve greater stability. In another embodiment the container is of a structural kind for use on a semi-submersible, arranged at an elevation where medium severe waves will not have hard impact on the container.

The above system is very similar to the riser storage and handling system used on Borgland Dolphin, Bideford Dolphin and a number of other rigs.

The pipes are partially exposed to wave loading for a semi-submersible application. The weight of the pipes in storage is carried by platform displacement and not by the risers' own buoyancy. Although, the centre of gravity is lowered this is not sufficient for deep water applications, which requires a large increase in deck load capacity. The pipes are stored in the splash zone, so that the storage container is exposed to severe wave loading. As for the US-patent above, the container is also here cantilevered from the deck, which requires heavier deck reinforcement.

U.S. Pat. No. 6,250,395 shows an apparatus system and method for installing and retrieving pipe in a well. The described system for storing and deploying long strings of jointed pipe adjacent to the drilling rig, is aiming at reducing the time spent to assemble and disassemble the pipe strings and also to reduce the payload requirements for the floating rig. The system incorporates a method to run the pipe string along a curvature higher than the yielding radius of the pipe, through more than 90 degrees, that is, from the vertical well to horizontal or vertical position, to be stored in water. Storage in water may be achieved in many forms, inside or outside carrier pipes, vertical or horizontal, suspended from rig or buoyed off on surface or in mid-water.

In this patent long sections of pipe string made up by assembling multiple joints end to end is moved over a large radius ramp from position in or above the well to a horizontally (through app. 90 degrees) or a vertically (through app. 180 degrees) submerged storage. The ramp structure takes a lot of space and contributes to a higher centre of gravity. As a consequence this solution does not achieve the main goal of the present invention.

U.S. Pat. No. 2,606,003 shows a system for drilling from a floating drilling unit, incorporating a marine riser with two flexible joints and a slip joint (now standard marine riser technology), incorporating as a secondary feature, a storage container which is mounted within and extends below the floating barge to provide for the substantially vertical storage of drill pipe. The mounting of the pipe storage container places the contained pipe principally below the deck of the barge, thereby lowering the centre of gravity of the barge and tending to stabilize the barge under wave action.

The container is closed to seawater, meaning that the pipe weight in storage is carried by the platform displacement. Since the storage container is mounted from the deck of the barge and down, the centre of gravity is not lowered as much as it should. Furthermore, the pipes are stored within the splash zone, resulting in an exposure to severe wave loading of the storage. The storage container is cantilevered from the deck, requiring heavier deck reinforcement.

U.S. Pat. No. 6,766,860 shows a system and means for hanging off an assembled string of tubulars (such as a full riser string) and skidding it away from the rotary to allow well operations outside the riser (such as running X-mas tree).

Since the riser is being kept assembled it is not accessible for inspection or repair. In that case, the riser must be retrieved, and the rig must have capacity to handle the string of riser on or over deck. Furthermore the riser is suspended from deck level and it is exposed to currents along the complete length of riser and to surface waves, as well as effects of rig motion, which puts operation limits on hanging off of the riser.

U.S. Pat. No. 6,524,049 shows a semi-submersible mobile drilling vessel with storage shaft for tubular drilling equipment, which is incorporating vertical storage of drilling tubulars inside one or more columns. This arrangement is being implemented on Pride's two new Amethyst designs for Petrobras, providing storage for 24 pieces of 65 ft length 21" riser joints. The tubulars are stacked in one or more columns with its associated steel weight and hydrodynamic loading. Riser weight in storage is carried by platform displacement. Although, the centre of gravity is lowered it is not lowered as much as it could have been. The structure containing the tubulars is exposed to severe wave loading. The tubulars have to be lifted up to deck level and brought from vertical into horizontal orientation and back into vertical orientation again for transport between the well centre and the storage.

U.S. Pat. No. 4,646,672 shows a semi-submersible vessel incorporating a centrally located buoyant caisson with internal drilling moonpool and provisions for vertical riser storage inside the caisson.

This arrangement has been used on Transocean's Jack Bates, a Friede & Goldman L-1020 Trendsetter built 1986 in Japan for vertical storage of 87 joints of 60' long 21" riser. As for the above reference, the tubulars are stacked in a column with its associated steel weight and hydrodynamic loading. Riser weight in storage is carried by platform displacement, not by the risers' own buoyancy. The lowering of the centre of gravity is not done to the extent that it could have, and the storage is situated in the splash zone.

WO 01/33029 describes a submerged pipe storage situated at the seabed.

The main object of the present invention is to lower the centre of gravity to an even lower position than most of the above references. A further object is to substantially avoid storing the tubulars in the splash zone, thereby avoiding heavy wave loads on the tubulars or the storage structure. An even further object is to a great extent to avoid deck loads imposed by the storage structure or the tubulars.

At least some of these objects are achieved by a system for storage of tubulars on a semi-submersible drilling and/or production unit, wherein the tubulars storage is submerged to a level substantially below the splash zone and preferably at the level of the lower hull (pontoons) of the semi-submersible unit, as defined by the characterizing portion of claim 1. Additional advantages are achieved by an apparatus according to the characterizing portion of claim 14. A method for disassembling a string into longer joints is achieved by a method according to the characterizing portion of claim 17. Storage of tubulars at the pontoon level would essentially eliminate the deck load (stability and displacement) and deck area requirements associated with storage of the tubulars when not in operation (suspended between the drilling unit and the seafloor). One potential benefit of this is to achieve an upgrade of a $2^{nd}$ or $3^{rd}$ generation shallow water unit to deep-water (typically 5000 ft water depth or more) capacity without a major structural rebuild of the hull.

In a preferred embodiment, the invention pertains a system that allows individual tubulars (such as riser joints) to be stored in open water below the splash zone, and transported individually or in groups of two or more from its storage position to the platform deck for inspection, preparation and installation on the riser string, and after retrieval, inspection and refurbishment back to its storage position.

Figure 2:
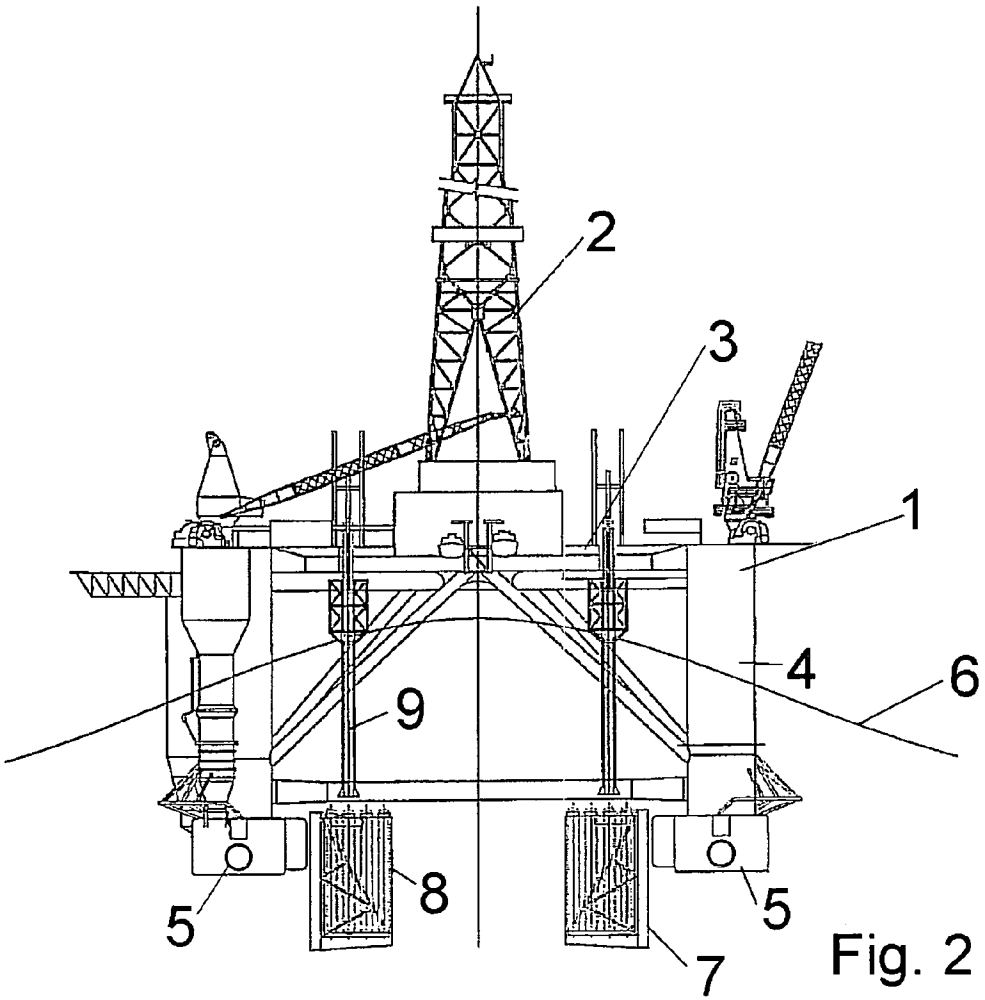
Figure 3:
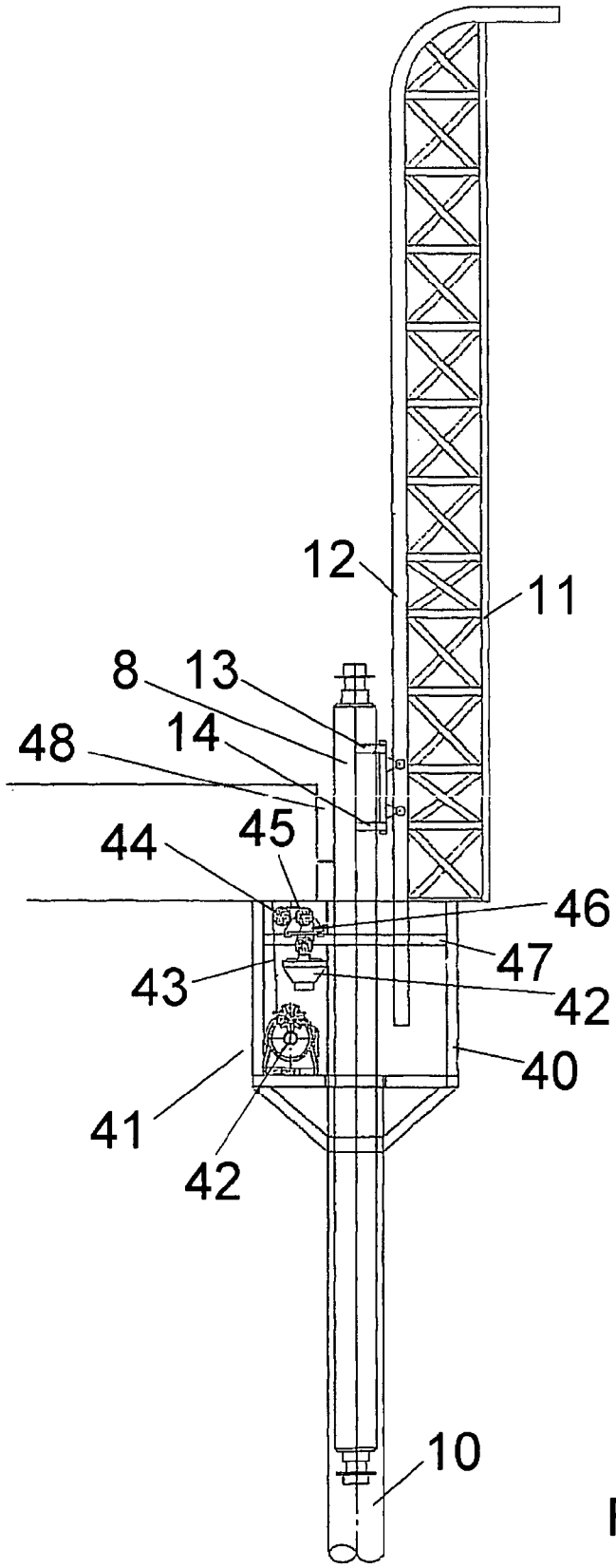
Figure 4:
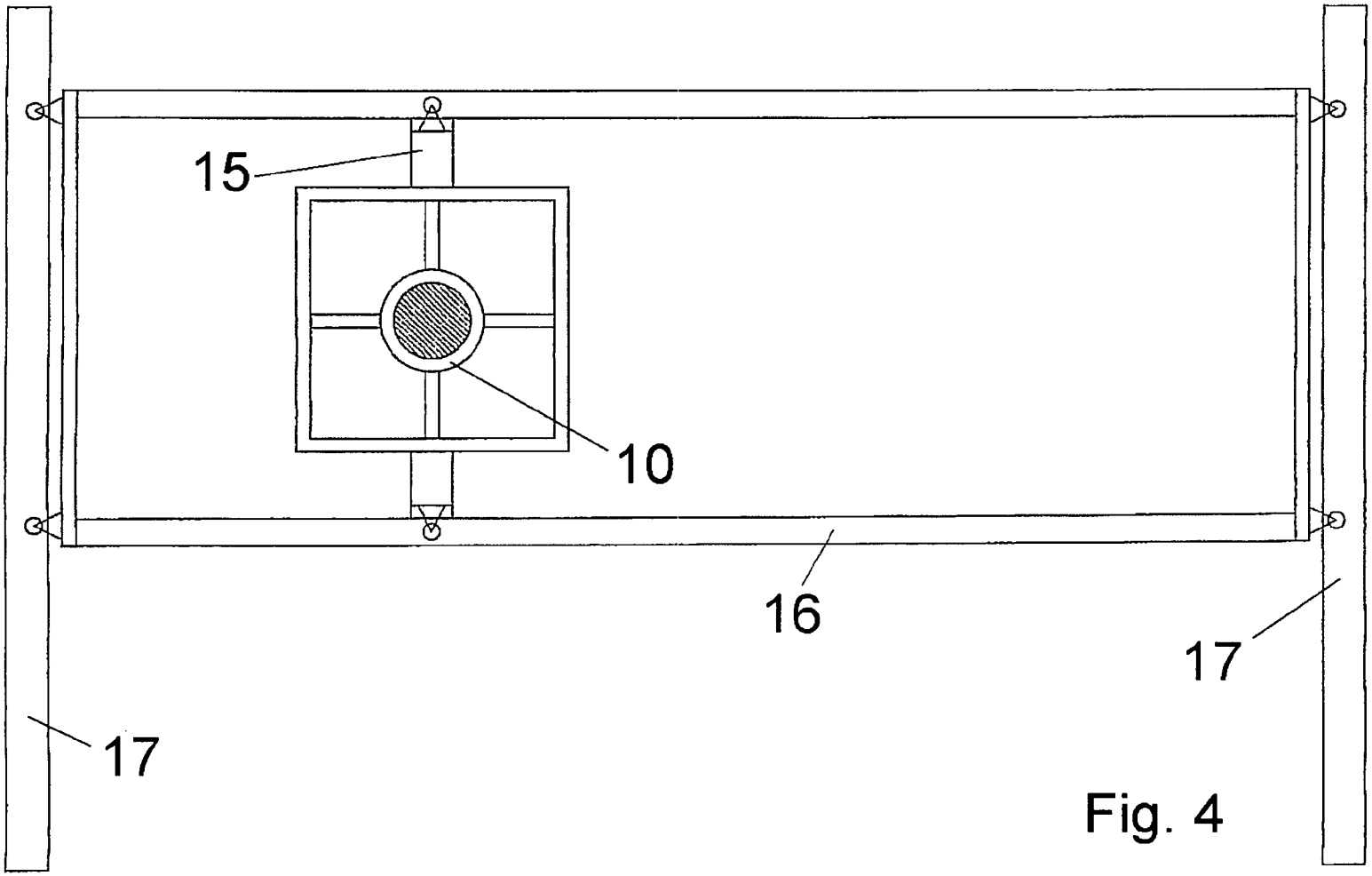
Figure 5:
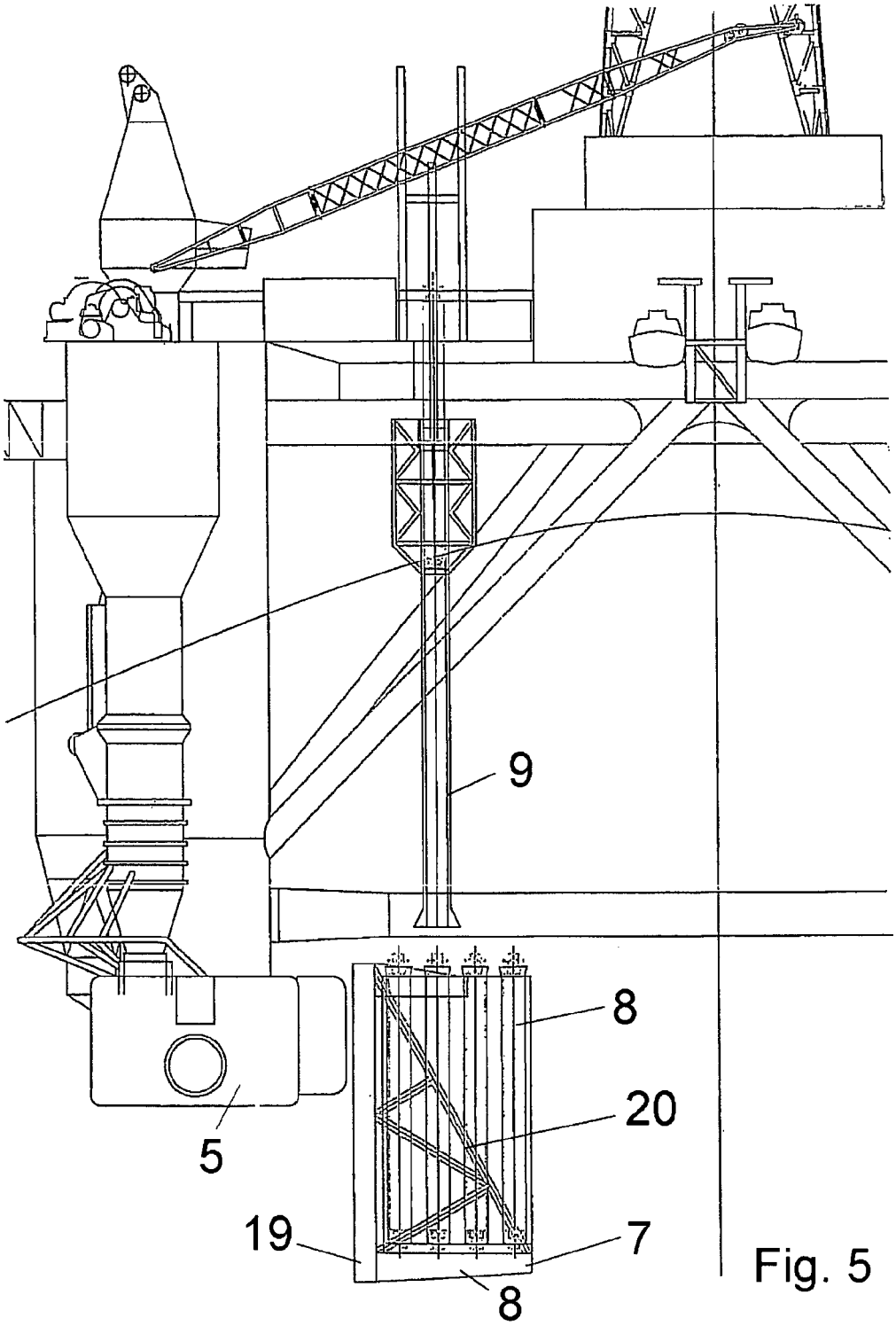

The invention will be explained in further detail, referring to the accompanying drawings that show exemplary embodiments of the invention, wherein:

FIG. 1 shows a side elevation view of a floating drilling and production platform having an underwater storage for tubulars according to the invention, FIG. 2 shows an aft elevation view of the platform in FIG. 1, FIG. 3 shows a detail of an apparatus for retrieving tubulars from and placing tubulars into the underwater storage, FIG. 4 shows a plan view of the retrieval apparatus of FIG. 3, FIG. 5 shows a section of the platform of FIG. 2, emphasizing the details of the underwater storage and the retrieval apparatus.

Figure 6:
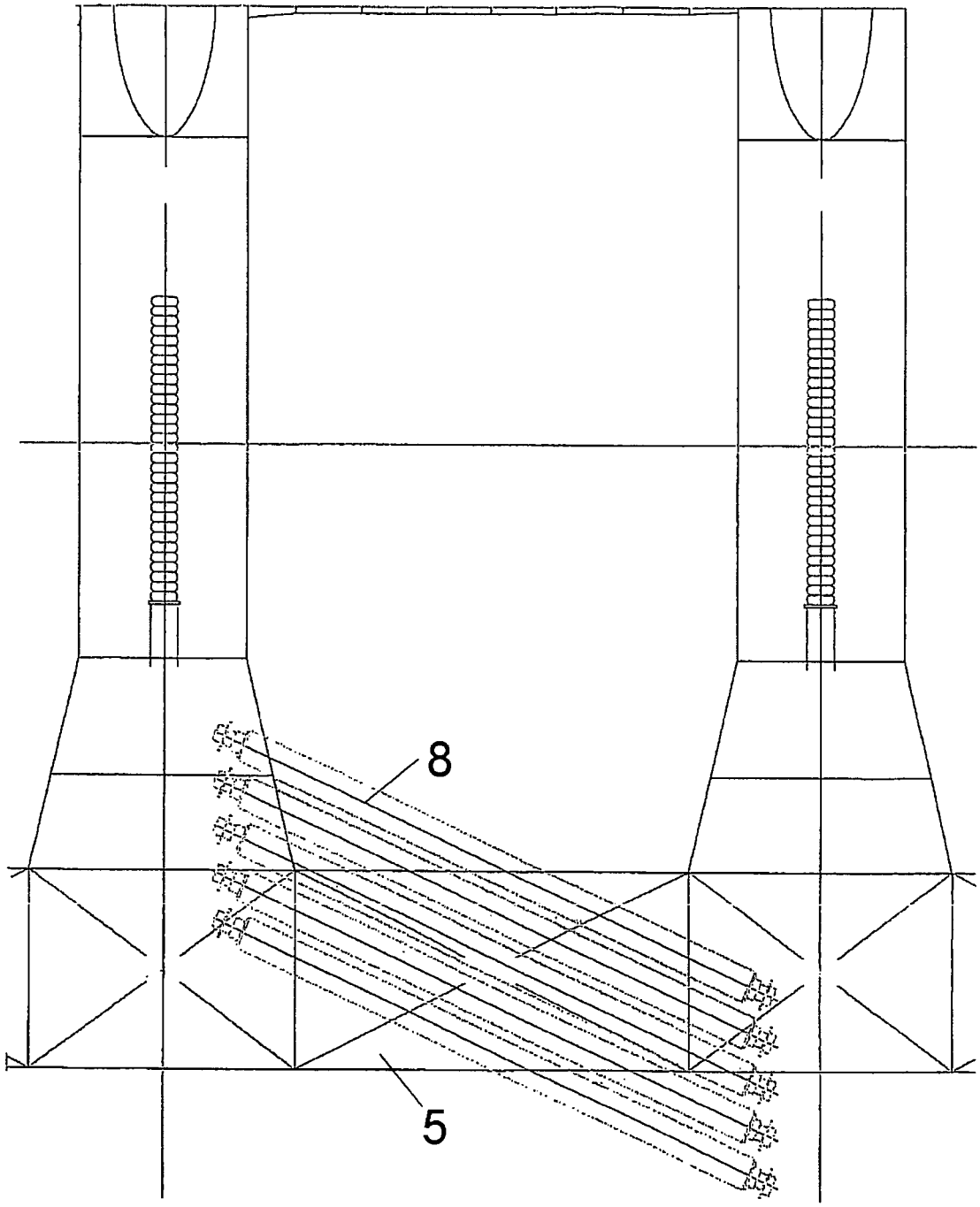
Figure 7:
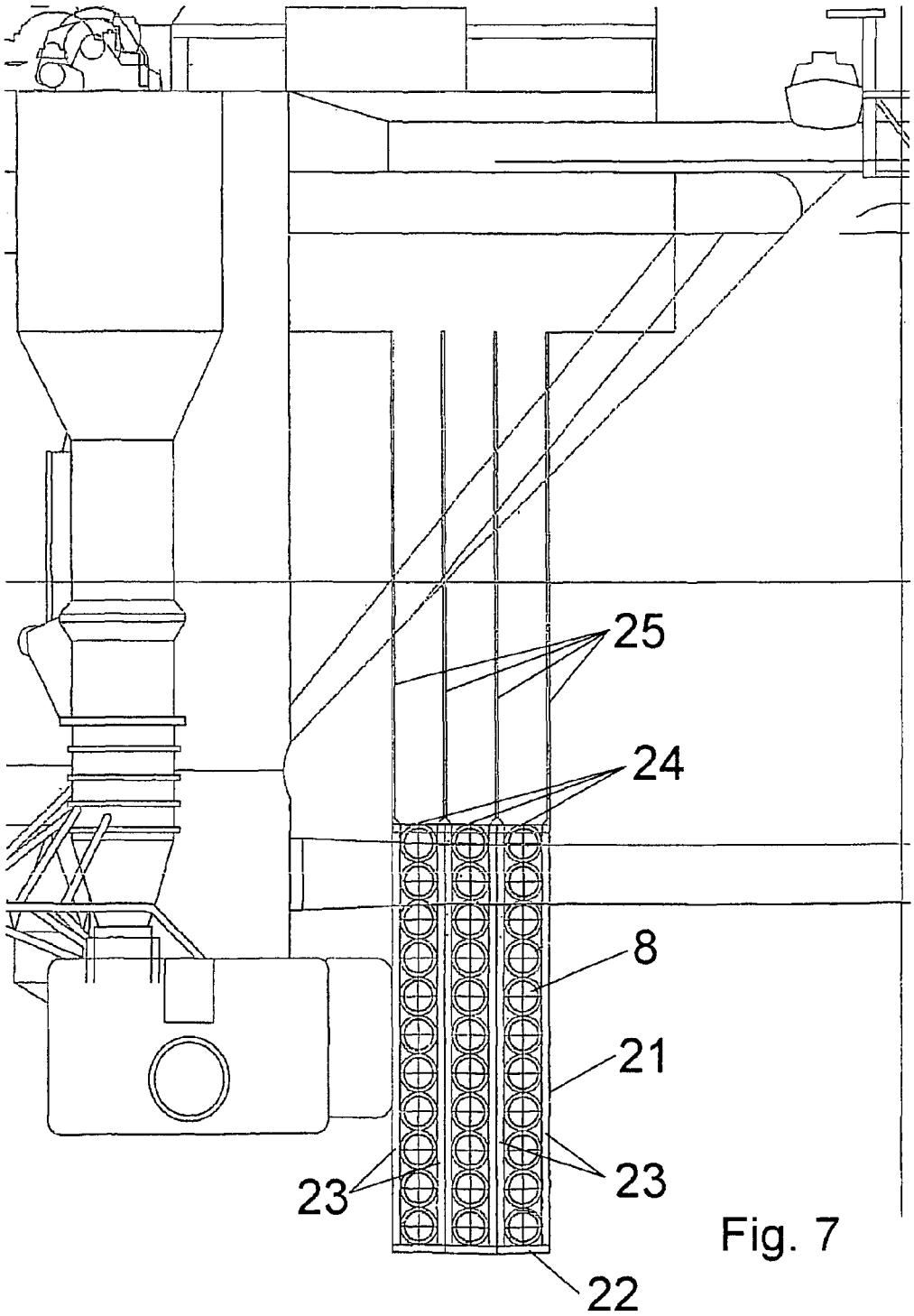
Figure 8:
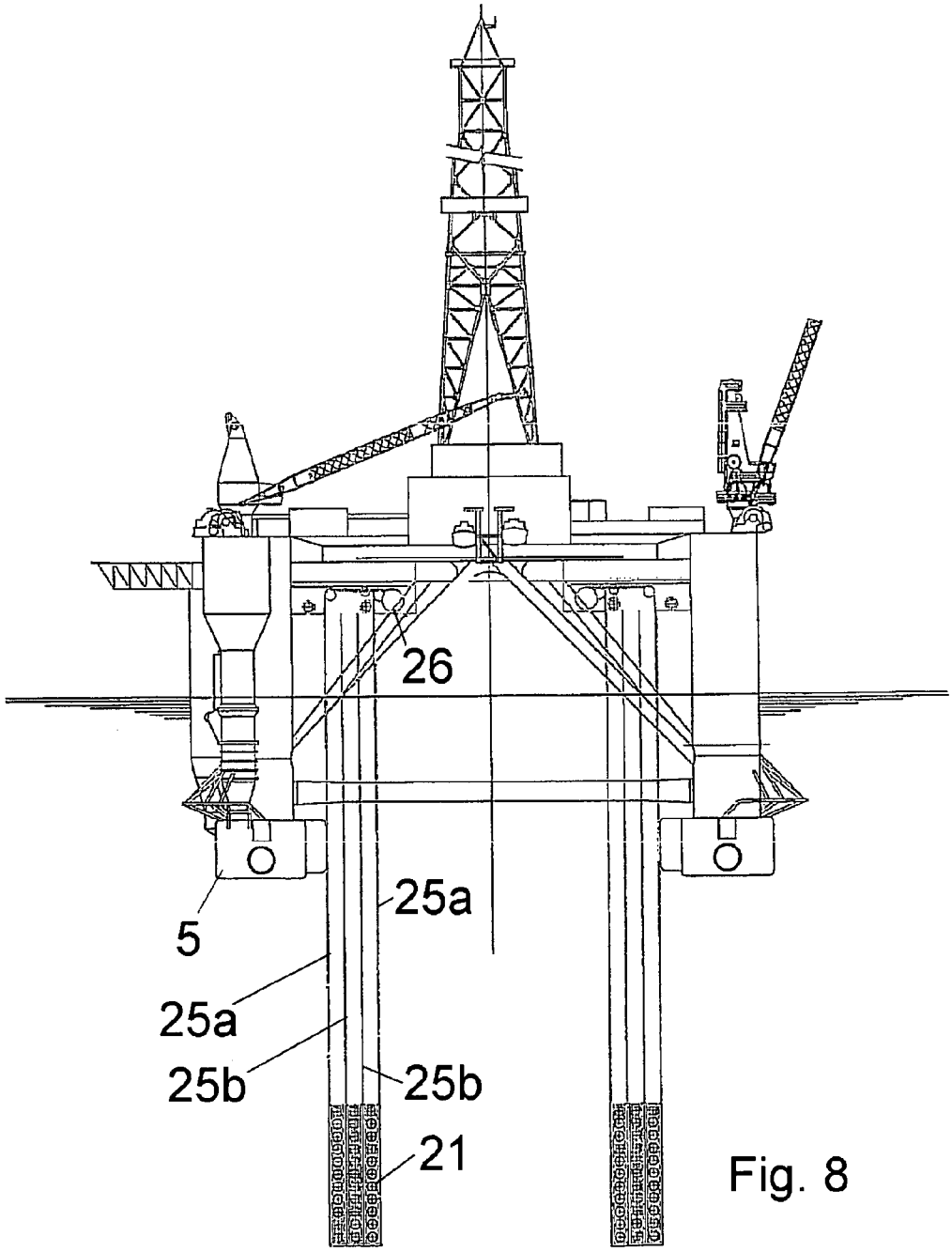
Figure 9:
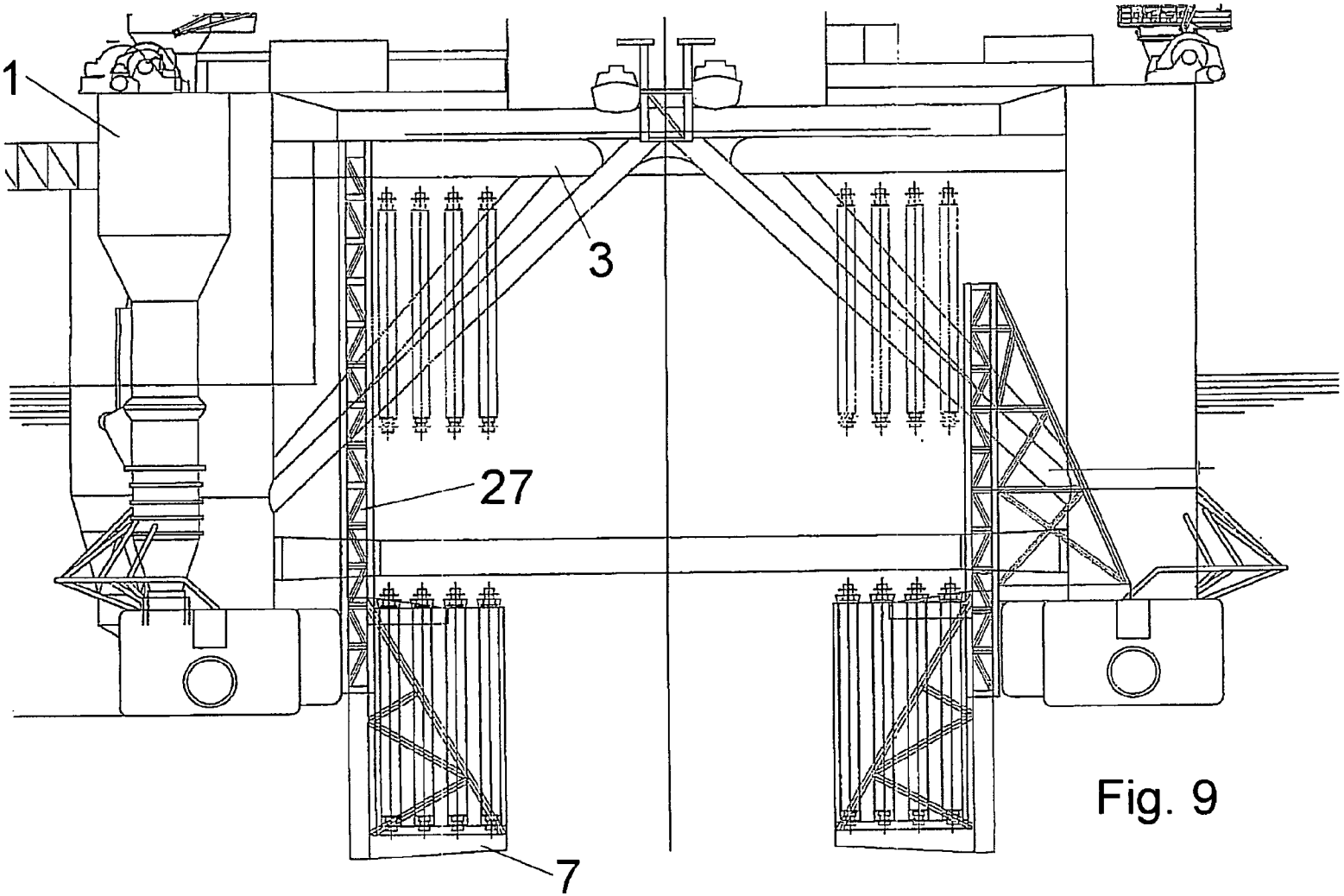
Figure 10:
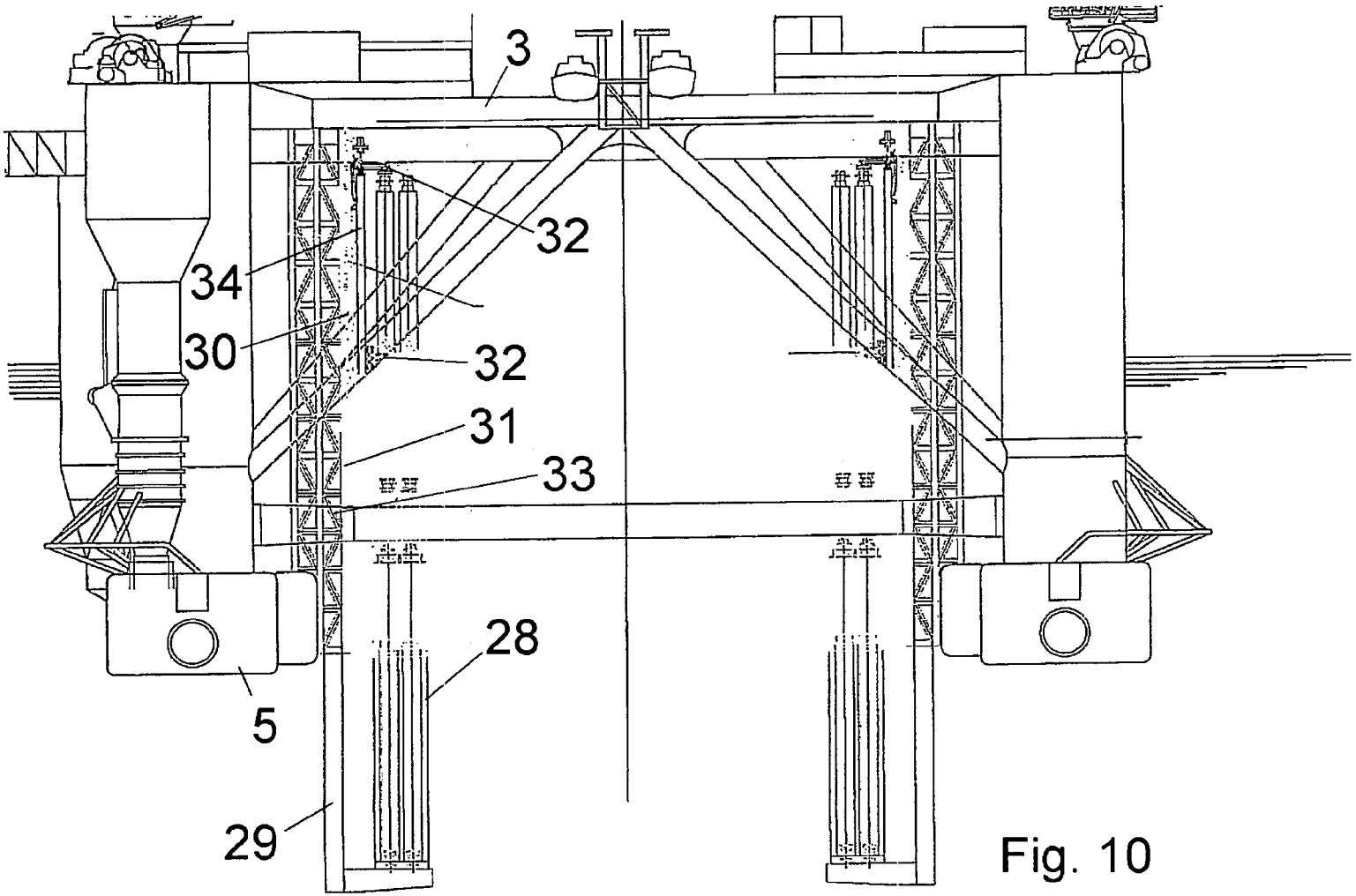
Figure 11:
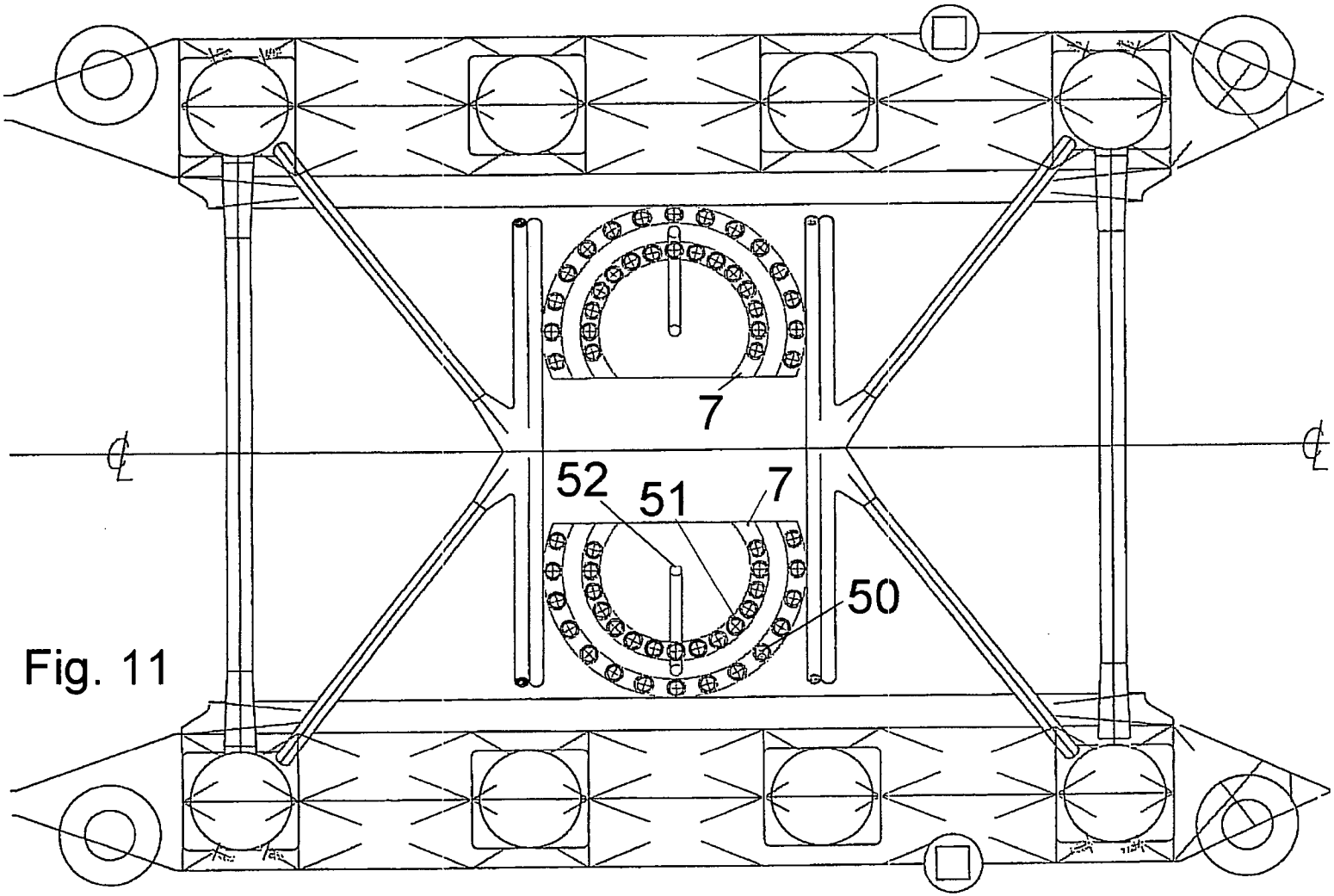
Figure 12:
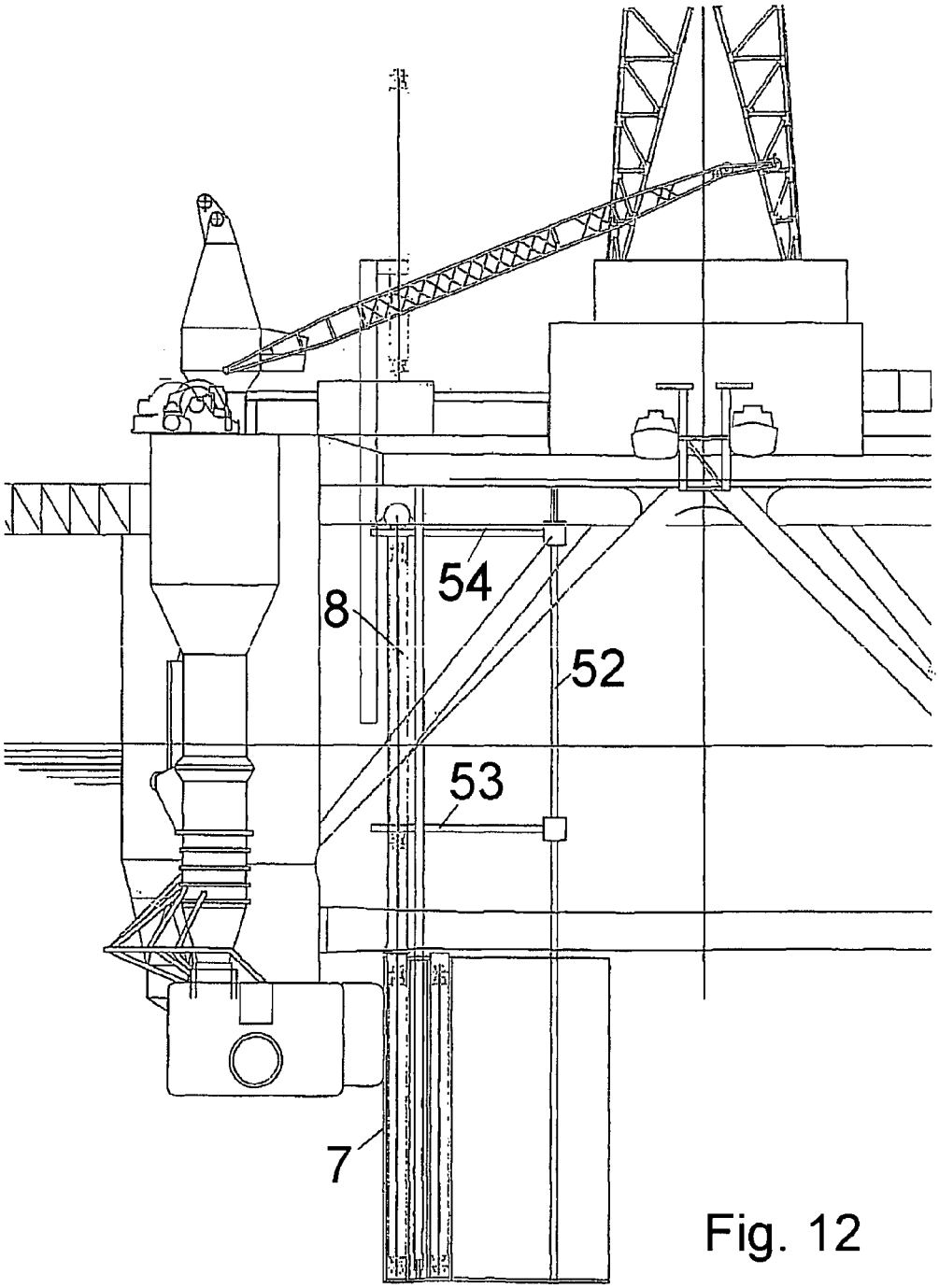
Figure 13:
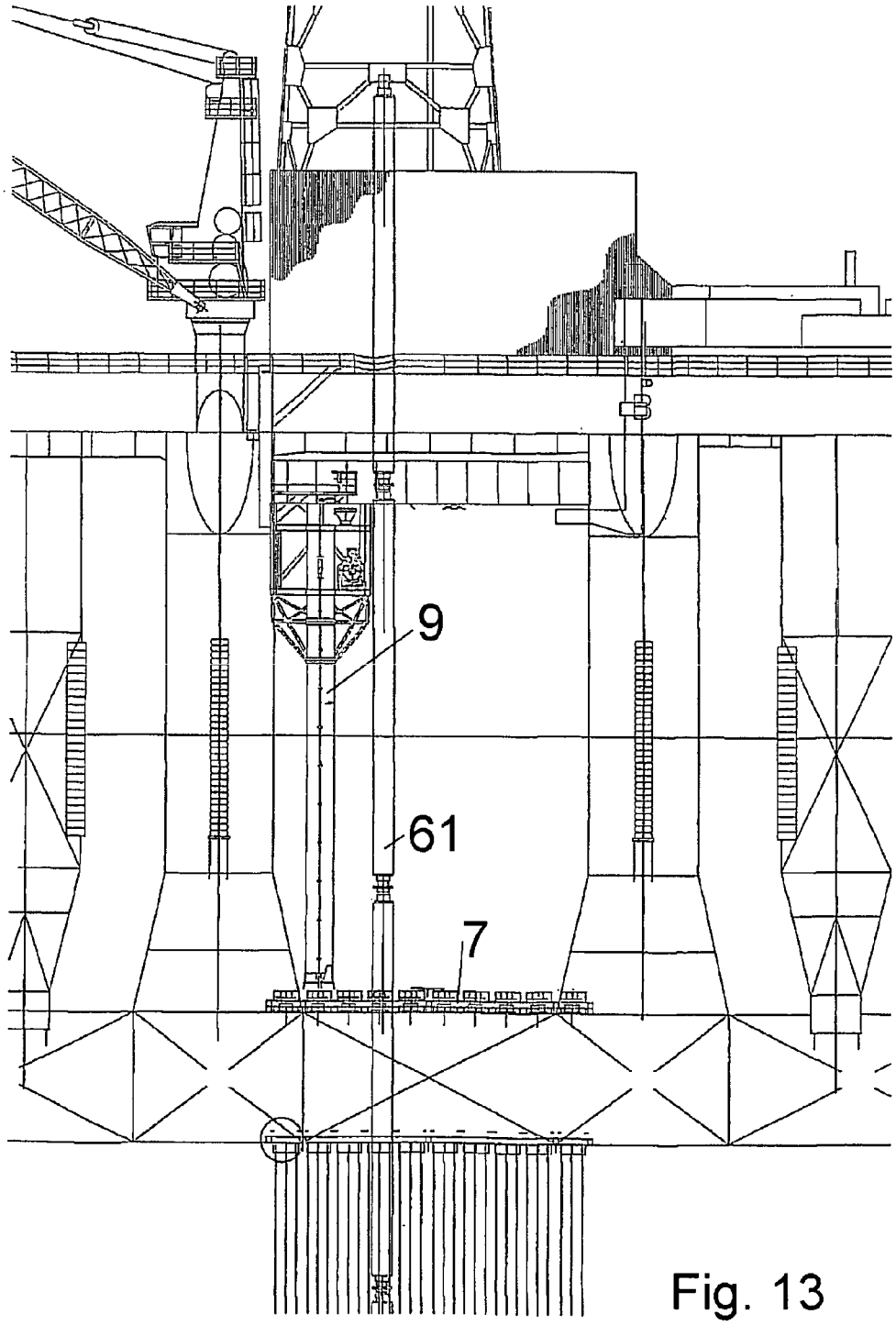
Figure 14:
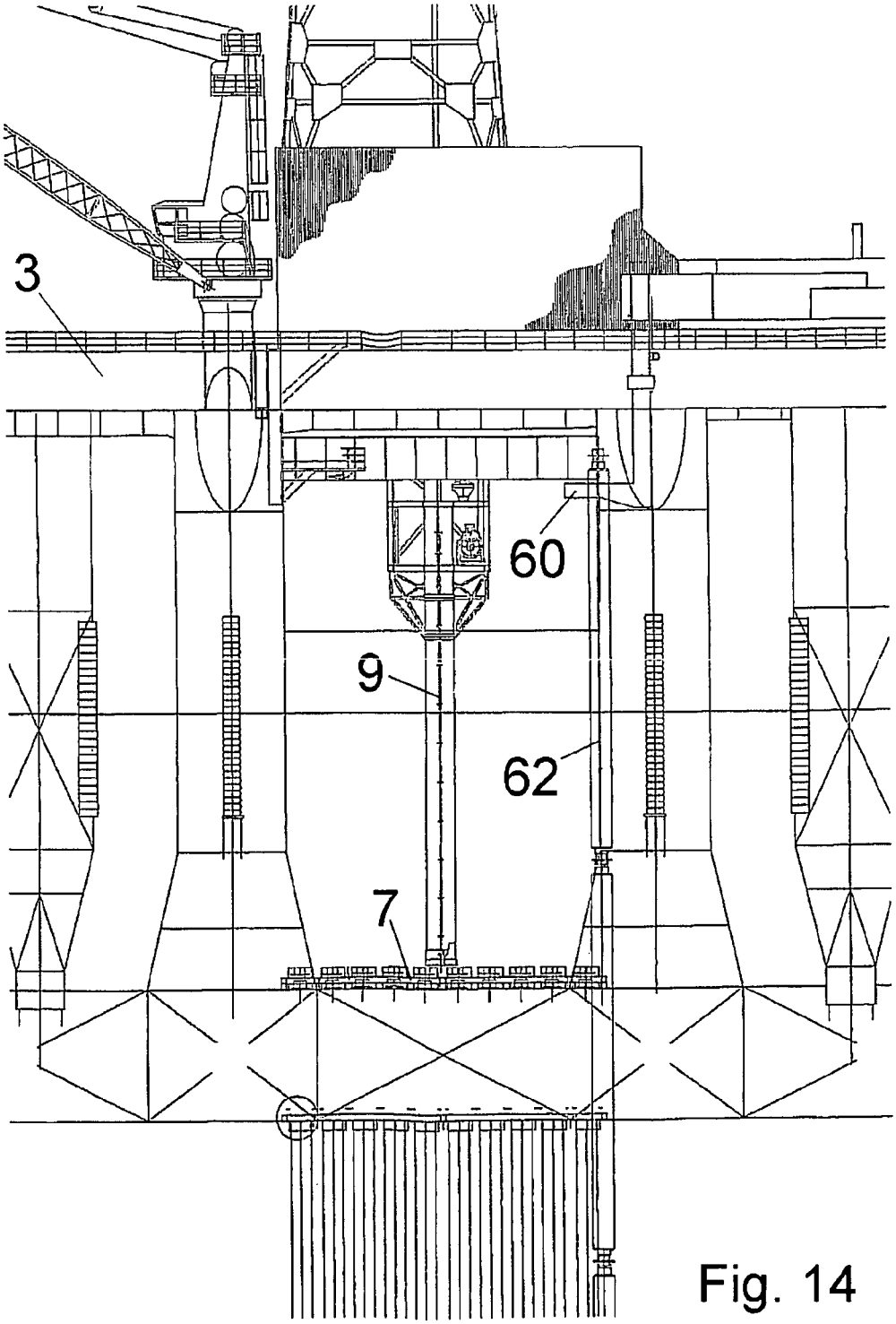

FIG. 6 shows a section of a side elevation view of an underwater storage for tubulars in an alternative embodiment of the present invention, FIG. 7 shows the underwater storage of FIG. 6 in a rear elevation view, FIG. 8 shows the underwater storage of FIGS. 6 and 7 in a bad-weather/emergency position, FIG. 9 shows a section of a side elevation view including an underwater storage that is liftable from an underwater position to a position generally above the water surface, FIG. 10 shows an aft elevation view of a further alternative embodiment of a storage device, which is vertically moveable and interacts with a retrieving apparatus, for transport of tubulars from a subsea position to an under-deck position, FIG. 11 shows a plan view of an even further embodiment of a storage device, associated retrieving apparatus, and, FIG. 12 shows an aft elevation view of the embodiment of FIG. 11, and FIGS. 13 and 14 illustrate a method for disassembling a pipe string.

FIGS. 1 and 2 show a first embodiment of the present invention. A floating platform 1 that can be used for drilling, production, intervention, etc. is equipped with a derrick 2. The platform 1 is generally consisting of a deck 3, columns 4 and a pair of pontoons 5. The pontoons 5 are the main feature ensuring buoyancy for the platform 1 while the columns 4 provide for stability. The water surface of the water in which the platform 1 is floating is denoted by reference number 6. As shown in FIG. 2, the water surface 6 may consist of a wave of varying magnitude.

A storage device 7 for tubulars (in this specific instance the tubulars are riser joints 8) is shown situated close to each of the pontoons 5. In this first embodiment the storage devices 7 are fixedly or disengageably connected to the pontoons 5.

A retrieving apparatus 9 for retrieving and putting back tubulars 8 is suspending from the deck 3 of the platform 1.

Referring to FIGS. 3, 4 and 5, the storage device and the retrieving apparatus will be explained in more detail. The retrieving apparatus 9 comprises a tube 10 for conveying tubulars there through. The tube 10 is fixed to a structure 40. On the structure 40 is also placed a hoisting device 41, comprising a winch 42, a gripping head 42 and a wire 43 extending there between. The wire 43 is running over two sheaves 44, 45. One of the sheaves 45 is placed on a small carriage 46, which is running on tracks 47 in the structure 40.

The structure 40 and the tube 10 are mounted on a first traverser carriage 15 (see FIG. 4), which in turn is traversing on a second traverser carriage 16. The second traverser carriage 16 is traversing on tracks 17 in the deck 3.

On the platform deck 3, close to a small moonpool 48 is a superstructure 11 having a track 12 for a trolley 13. The trolley 13 is equipped with grippers 14 for gripping a tubular 8. The structure 40 with the tube 10 is adapted to be positioned under the moonpool 48 to hand over a tubular 8 to the trolley 13, as will be explained below.

The storage device 7 comprises a horizontal bottom 18 carried by a side wall 19, so that these two parts form a generally L-shaped structure. Within the L-shaped structure is a framework 20, which is divided into compartments, each compartment being adapted to receive a tubular 8.

Referring to FIG. 5, the function of the storage device 7 and the retrieving apparatus 9 will be explained.

FIG. 5 shows the storage device 7 attached to the pontoon 5 and loaded with riser joints 8. Above the storage device 7 the retrieving apparatus 9 is positioned. The positioning of the retrieving apparatus 9 is carried out by movement of the two traverser carriages 15, 16. The retrieving apparatus 9 is capable of being positioned above each of the compartments of the storage device 7. Optionally, the tube 10 of the retrieving apparatus 9 can connect to the storage device 7 when it is positioned for transfer of a riser joint 8.

When a riser joint is to be retrieved the gripper head 42 is run down into the tube 10 to grip a riser joint 8. The riser joint is then lifted up through the tube 10 through the splash zone. The tube 10 protects the riser joint 8 during the movement through the splash zone. The retrieving apparatus then moves to the moonpool 48 to deliver the riser joint 8 there through. The trolley 13 then grips the upper part of the riser joint 8. A separate hoisting apparatus, such as a crane (not shown), can connect to the riser joint 8 to facilitate the lifting of the riser joint, while the trolley 13 acts as a guide. The track 12 extends through a curve at the top into a horizontal stretch. Consequently, the riser joint 8 can be shifted into a horizontal position when it has cleared the moonpool 48.

There may be one or more moonpools in the deck 3 for retrieving tubulars. The drilling moon-pool can also be used for this (as will be explained in further detail below).

The re-insertion of the riser joints 8 in the storage device 8 is performed by reversing the above action.

In a variant embodiment (which is not illustrated) of the above, the storage device is placed at the perimeter of the platform so that a retrieving apparatus can reach the tubulars from the outside of the platform deck. A tipping board, which is hingedly connected to the platform deck, can be arranged at the edge of the platform deck to tip the tubular from vertical to horizontal position or vice versa.

Preferably the main and auxiliary pipe bores of the riser joints 8 are capped at both ends, as illustrated, e.g., in FIGS. 3, 5, 6 and 9, so that seawater cannot enter into the inside thereof. Alternatively, the interior may be filled with a non-corrosive fluid. In a further alternative, the end caps may be designed to allow seawater to enter, but limit circulation, so that corrosion and marine growth by the internal fluid environment may be controlled by anodes and or chemical treatment. Depending on the amount of fixed buoyancy on the riser, this results in a close to neutral buoyancy of the tubulars 8. If heavier weight in water is preferred, the tubulars may be filled with a fluid that is heavier in water. Consequently, no extra buoyancy and no extra deck load capacity are usually required. The storage device 7 itself is on the other hand open to seawater, so that seawater has access to the outside of the riser joints 8. It has been found that a proper alloy can withstand this exposure to seawater for prolonged periods of time without detrimental effects. If the tubulars are made of a composite material (like carbon fibers in an epoxy matrix) these can endure even longer submerged periods.

FIG. 6 illustrates tubulars 8 that are stored in an inclined position close to the pontoon 5.

FIG. 7 illustrates an alternative embodiment of a storage device 7 that can be used for storing tubulars 8 in an inclined or (as shown) horizontal position. The storage device 7 of FIG. 7 comprises a basket 21 having a bottom 22 and vertical walls 23, dividing the basket into, in this example, three separate compartments 24. In each compartment the tubulars 8 are lying directly on top of each other. The basket 21 is suspended from the platform deck 3 by wires 25. The retrieval of the tubulars can be carried out by hoisting the basket 21 up to the platform deck 3, optionally through a moonpool in the platform deck 3. To this end a winch 26 is used (see FIG. 8) that can wind up the outboard wires 25*a* simultaneously. The inboard wires 25*b* act as guide wires. Preferably, the storage device 7 is connected to the pontoon 5 by guides, so that it is prevented from slamming into the pontoon 5 due to movement of the platform 1.

The essentially horizontal position makes it possible to transfer the riser joints 8 up to deck level along a slanted chute or track, minimizing the requirements for deck openings and deck area.

In FIG. 8 the baskets are lowered to a position well below the pontoons 5. This is a position for emergency in the case of bad weather. In this position the baskets 21 with the tubulars 8 contributes to a lowering of the centre of gravity of the platform 1 and also act as drag anchors. Thereby the stability of the platform will increase, meaning that not only will this positioning of the tubulars remove the disadvantage of having a substantial load in an elevated position but also have a positive effect that becomes greater the more the tubulars weigh.

The storage may extend over a smaller part of the horizontal extent of the platform or extends along a major part of the horizontal extent of the platform. The storage can be divided into several independent storage devices to facilitate the handling.

FIG. 9 shows a further alternative embodiment. Here a storage device 7, which in principle has the same construction as the storage device of FIG. 2 is mounted vertically displaceable on a track 27 that is attached to the platform 1. The storage device 7 can be elevated along the track 27 to a position immediately below the platform deck 3 or even partly above this. Thereby the retrieval and putting back of the tubulars 8 can be done by gripping devices on the platform deck 3 or a conventional crane.

FIG. 10 shows a further embodiment of the present invention. Here the tubulars are stored in a basket 28 that is placed on an L-shaped support 29. The L-shaped support may be liftable along a guide structure 33, at least to a position close to the pontoon 5. A retrieving apparatus 34 is mounted on a trolley 30 that is moveable on a track 31 attached to the guide structure 33. The retrieving apparatus 34 is equipped with grippers 32 that are adapted to grip the basket 28. Thus, the basket can be lifted from the L-shaped support 29 to a position immediately below or even partly or fully above the platform deck 3.

FIGS. 11 and 12 show an even further embodiment of the present invention. Here a semi-circular storage device 7 is placed at each side of the drilling moonpool. The tubulars are placed in two or more concentric segments 50, 51. A retrieving apparatus 9 comprise a vertical column 52 placed in the center of the semi-circles 50, 51 that is capable of rotation about its vertical axis. A pair of arms 53, 54 is coupled to the column 52 and are capable of vertical movement along the column. At the outer ends of the arms 53, 54 are grippers or similar (not shown) adapted to grip a tubular 8. In order to serve more than one semi-circle of tubulars 8, the arms 53, 54 may be retractable. Preferably, the retrieving apparatus 9 is also capable of reaching the drilling axis, so that tubulars may be brought directly to and from the drilling axis without the need to transport the tubulars over deck.

In certain embodiments of the apparatuses and devices described above, they can be used for disassembling or assembling a riser 61 or other pipe string into or from longer joints than conventional equipment. FIGS. 13 and 14 illustrate a method for performing this operation. A spider or other type of hang-off device 60 is suspended for gripping the riser string 61 below the platform deck 3. After hanging off the riser 61 in the spider 60 below the platform deck 3, the spider 60 and the riser string 61 is subsequently moved to one side of the drilling axis, as shown in FIG. 14. A retrieving apparatus 9 can then be moved into the drilling axis, and the part of the riser (not shown) hanging from the block in the derrick can then be lowered into the retrieving apparatus 9. The retrieving apparatus 9 then carries the joint to the underwater storage. In FIG. 14 the joint has just been put back into the storage device 7. Alternatively, the joint can be brought up thorough the platform deck 3, e.g. by a crane, and stored on the deck or transferred to a utility vessel.

This part or joint of the riser can be as long as the distance from the uppermost position of the block of the derrick down to a short distance below the platform deck. This is maybe twice as long as the longest joints that can be brought out from the derrick over the drill floor.

When the retrieving apparatus 9 has traveled out of the drilling axis, the spider 60 carrying the riser 61 will bring the riser back into the drilling axis. Here the block in the derrick will connect to the top of the riser 61 and hoist the riser upwards into the derrick (as illustrated in FIG. 13). Then the spider 60 connects to the riser 61 again and the riser is disconnected just above the spider 60. After the spider 60 again has brought the riser 61 out of the drilling axis (as shown in FIG. 14), the retrieving apparatus 9 is once more brought into the drilling axis to receive the part of the riser hanging from the block. The string 61 can be assembled by reversing the sequence above.

Consequently, an additional advantage of the present invention is the possibility to operate with longer riser joints, which is a governing parameter for operating efficiency in deep water.

The invention claimed is:

1. An apparatus for storing tubulars on a floating semi-submersible vessel, comprising a storage device for storing tubulars in a submerged position, essentially below a splash zone, wherein the storage device is generally open to the surroundings so that the tubulars are externally exposed to surrounding water, the storage device is substantially vertically moveable relative to the floating vessel, and the storage device is moveable on a track that is fastened to the floating vessel.

2. Apparatus according to claim 1, wherein it is adapted to receive the tubulars divided into relatively short lengths of pipe.

3. Apparatus according to claim 1, wherein the storage device is coupled to a lower part of the floating vessel.

4. Apparatus according to claim 1, wherein the storage device is liftable by wires.

5. Apparatus according to claim 1, wherein the storage device is adapted to be lowered to a position substantially below the bottom of the floating vessel, to increase stability of the floating vessel during bad weather.

6. Apparatus according to claim 1, further comprising a retrieving apparatus for lifting tubulars from the storage device to a position close to or above a deck on the floating vessel.

7. Apparatus according to claim 6, wherein the retrieving apparatus comprises a shield, through which shield a tubular is conveyable through the splash zone.

8. Apparatus according to claim 6, wherein the retrieving apparatus is adapted for coupling to the storage device when positioned for retrieving or putting back a tubular.

9. Apparatus according to claim 1, wherein the tubulars are capped at the ends thereof to prevent water from exposing the interior of the tubulars and optionally the sealing surfaces.

10. Apparatus according to claim 1, wherein the apparatus is adapted for transporting tubulars between a storage and a derrick on an offshore platform having a platform deck, and wherein the apparatus is situated below the platform deck and is adapted for movement under the platform deck.

11. Apparatus according to claim 10, wherein the apparatus is adapted for transporting tubulars into and out of a drilling axis below the platform deck.

12. Apparatus according to claim 10, wherein the apparatus is adapted for transporting tubulars into and out of an under water storage.

13. An apparatus for storing tubulars on a floating semi-submersible vessel, comprising a storage device for storing tubulars in a submerged position, essentially below a splash zone, wherein the storage device is generally open to the surroundings so that the tubulars are externally exposed to surrounding water; and a retrieving apparatus for lifting tubulars from the storage device to a position close to or above a deck on the floating vessel, wherein the retrieving apparatus comprises a trolley equipped with grippers for gripping one or more tubulars, the trolley being moveable between a position close to or above the deck of the vessel to a position close to the storage device.

14. Apparatus according to claim 13, wherein the apparatus is adapted for transporting tubulars between a storage and a derrick on an offshore platform having a platform deck, and wherein the apparatus is situated below the platform deck and is adapted for movement under the platform deck.

15. Apparatus according to claim 14, wherein the apparatus is adapted for transporting tubulars into and out of a drilling axis below the platform deck.

16. Apparatus according to claim 14, wherein the apparatus is adapted for transporting tubulars into and out of an under water storage.

17. An apparatus for storing tubulars on a floating semi-submersible vessel, comprising a storage device for storing tubulars in a submerged position, essentially below a splash zone, wherein the storage device is generally open to the surroundings so that the tubulars are externally exposed to surrounding water; and a retrieving apparatus for lifting tubulars from the storage device to a position close to or above a deck on the floating vessel, wherein the retrieving apparatus is moveable in a horizontal plane by at least one traverser carriage.

18. Apparatus according to claim 17, wherein the apparatus is adapted for transporting tubulars between a storage and a derrick on an offshore platform having a platform deck, and wherein the apparatus is situated below the platform deck and is adapted for movement under the platform deck.

19. Apparatus according to claim 18, wherein the apparatus is adapted for transporting tubulars into and out of a drilling axis below the platform deck.

20. Apparatus according to claim 18, wherein the apparatus is adapted for transporting tubulars into and out of an under water storage.

21. Method for disassembling a pipe string on an offshore platform having a deck and a derrick, comprising:

hanging off a lower part of the string at a level below the platform deck, disconnecting the string above the hang off level, moving the lower part of the string away from the drilling axis, bringing a retrieving apparatus into the drilling axis, transferring the upper part of the string to the retrieving apparatus, moving the retrieving apparatus and the upper part of the string away from the drilling axis, moving the lower part of the string into the drilling axis, lifting the lower part of the string into the derrick, repeating the previous steps until the string has been disassembled.

* * * * *